US007856689B2

(12) United States Patent
Habimana

(10) Patent No.: US 7,856,689 B2
(45) Date of Patent: Dec. 28, 2010

(54) BABY DIAPER-CHANGING PAD COVER

(76) Inventor: Yolonda P. Habimana, 12395 Red Hawk Dr., Frisco, TX (US) 75034

( * ) Notice: Subject to any disclaimer, the term of this patent is extended or adjusted under 35 U.S.C. 154(b) by 0 days.

(21) Appl. No.: 11/852,279

(22) Filed: Sep. 8, 2007

(65) Prior Publication Data

US 2009/0064412 A1 Mar. 12, 2009

(51) Int. Cl.
*A47C 16/00* (2006.01)

(52) U.S. Cl. ..... 5/655; 5/490; 5/738

(58) Field of Classification Search ..... 5/482, 5/489, 497, 499, 922, 923, 655, 636, 417, 5/420, 690, 652, 655.9, 495, 737, 738, 490
See application file for complete search history.

(56) References Cited

U.S. PATENT DOCUMENTS 3,109,474 A * 11/1963 Levi ..... 150/158
3,489,194 A * 1/1970 Hoover ..... 383/4
3,638,249 A * 2/1972 Katsigarakis ..... 5/159.1
4,125,903 A 11/1978 Farrell
4,698,862 A 10/1987 Mairs
4,773,702 A 9/1988 Takahashi et al.
4,886,150 A * 12/1989 Fitzsimmons ..... 190/1
4,967,428 A * 11/1990 Browder ..... 5/419
5,430,902 A * 7/1995 Lewis ..... 5/490
5,551,109 A * 9/1996 Tingley et al. ..... 5/655
5,642,540 A * 7/1997 Culver et al. ..... 5/499
5,692,257 A 12/1997 Albertieri
6,065,164 A * 5/2000 Swanger et al. ..... 5/420
6,067,677 A * 5/2000 Reen et al. ..... 5/499
6,199,231 B1 * 3/2001 Zafiroglu ..... 5/497
6,298,509 B1 * 10/2001 Vickers ..... 5/655
6,298,993 B1 10/2001 Kalozdi
6,327,726 B1 12/2001 Weber
6,745,419 B1 * 6/2004 Delfs et al. ..... 5/691
7,003,832 B2 * 2/2006 Wilson ..... 5/655

* cited by examiner

*Primary Examiner*—Robert G Santos
*Assistant Examiner*—Nicholas Polito

(57) ABSTRACT

A baby diaper-changing pad cover for covering a traveling baby diaper-changing pad includes a front member, a first side member connected to the front member, a second side member connected to the front member, a top member connected to the front member, a bottom member connected to the front member and a back member connected to the first side member, the second side member, the top member and the bottom member. The traveling baby diaper-changing pad can be removed and inserted into the baby diaper-changing pad cover, and the front member includes a slit to insert and remove the traveling baby diaper-changing pad.

1 Claim, 2 Drawing Sheets

BABY DIAPER-CHANGING PAD COVER

The typical parent uses a large number and variety of products while caring for a baby and meeting its many needs. The need for so many products seriously cuts into the parent's mobility and time. Taking the baby along on even the shortest journey or errand frequently requires assembling a large number of objects and loading them individually into the family car. Certain attempts have been made to provide more convenient baby accessories by combining two or three items into a single bag or blanket. An example of these prior art attempts can be seen in U.S. Pat. No. 4,125,903, U.S. Pat. No. 4,698,862 and U.S. Pat. No. 4,886,150. However, certain drawbacks still exist even with the large number of baby products currently available. More specifically, none of the prior art devices discloses a baby traveling baby diaper-changing pad which is suitable for parents lifestyle.

Traveling with babies present special challenges and needs. It is almost impossible to travel with babies without the need to change the diaper of the baby. When changing the diaper of the baby while traveling, it is desirable to place the baby on a pad. This pad provides some cushioning from the hard surface of most baby diaper changing areas. Furthermore, the traveling baby diaper-changing pad provides a somewhat sanitized area for placing the baby. The traveling baby diaper-changing pad is usually a flexible pad which can be readily folded in order to transport the traveling baby diaper-changing pad in a convenient pouch or bag. However, the flexible pad may be formed with material which is relatively cold to the touch, and consequently, when a baby is placed on the traveling baby diaper-changing pad the baby may react to the cold sensation from the traveling baby diaper-changing pad by wetting himself/herself. This provides an additional mess which must be cleaned up by the caretaker of the baby. However, providing the traveling baby diaper-changing pad with an integral cloth surface does not provide a satisfactory solution because the integral cloth surface would have to be washed along with the traveling baby diaper-changing pad each time that the integral cloth surface is soiled. Until the integral cloth surface had been washed, the traveling baby diaper-changing pad is not usable.

U.S. Pat. No. 5,692,257 discloses a baby blanket foldable to form a bunting and a bag including a soft cloth panel having a left edge a spaced opposite right edge. The cloth panel includes an upper, middle and lower section, which each extend from the left edge to the right edge. Left and right panels are pivotally connected to the left and right edges, respectively. The cloth panel is spread out with the left and right panels extending to form a large, soft baby blanket or changing cloth. The lower section is folded over and secured to the middle section along the edges to define a baby receiving and holding compartment. The left and right panels are then folded in toward each other over the lower section to form the bunting. Alternatively, the sections are folded to substantially overlie each other, and one of the panels is folded over several times to substantially overlie the other panel to form a compact bag.

U.S. Pat. No. 6,327,726 discloses a baby diaper-changing pad suitable for use in a passenger motor vehicle having at least two rows of seats has a roll-up mat of an elastic material which has at two opposite ends straps and/or loops by which the mat can be affixed to two head supports of two seats of the vehicle disposed one behind the other in the direction of travel. A soft baby pad is provided on the inner side between the ends with the straps and/or loops. The arrangement of the baby pad on the mat and the dimensions of the mat and of its straps and/or loops are chosen such that, when the mat is affixed to the head supports, it rests in that area with its exterior on a seat surface of the rear seat in the direction of travel in which the baby pad is disposed on the inner side of the mat.

U.S. Pat. No. 4,773,702 discloses a reversible cover for a baby seat with a three-dimensional seat support, comprising a core of foamed urethane with a smooth side and a side with hills and valleys and a cover around the core. The cover is made of air breathing seersucker on the smooth side of the core and is made of soft, insulating pile on the hill-and-valley side. The cover closely conforms to the seat support and can be reversed with the pile side being used during the winter and the seersucker side during the summer.

SUMMARY

The present invention relates to a baby diaper-changing pad cover for a traveling baby diaper-changing pad which is easily carried suitable for use in a mall or other area where it would be desirable to change a diaper.

The present invention provides a baby diaper-changing pad cover which can eliminates the problems noted above. The baby diaper-changing pad cover provides a warm and soft cover to allow the traveling baby diaper-changing pad to be inserted and removed.

A baby diaper-changing pad cover for covering a traveling baby diaper-changing pad includes a front member, a first side member connected to the front member, a second side member connected to the front member, a top member connected to the front member, a bottom member connected to the front member and a back member connected to the first side member, the second side member, the top member and the bottom member.

The traveling baby diaper-changing pad can be removed and inserted into the baby diaper-changing pad cover, and the front member includes a slit to insert and remove the traveling baby diaper-changing pad.

The front member includes a first portion, and the front member includes a second portion.

The front member includes an overlapping portion, and the baby diaper-changing pad cover includes a soft material.

BRIEF DESCRIPTION OF THE DRAWINGS

The invention may be understood by reference to the following description taken in conjunction with the accompanying drawings, in which, like reference numerals identify like elements, and in which.

DETAILED DESCRIPTION

Figure 1:
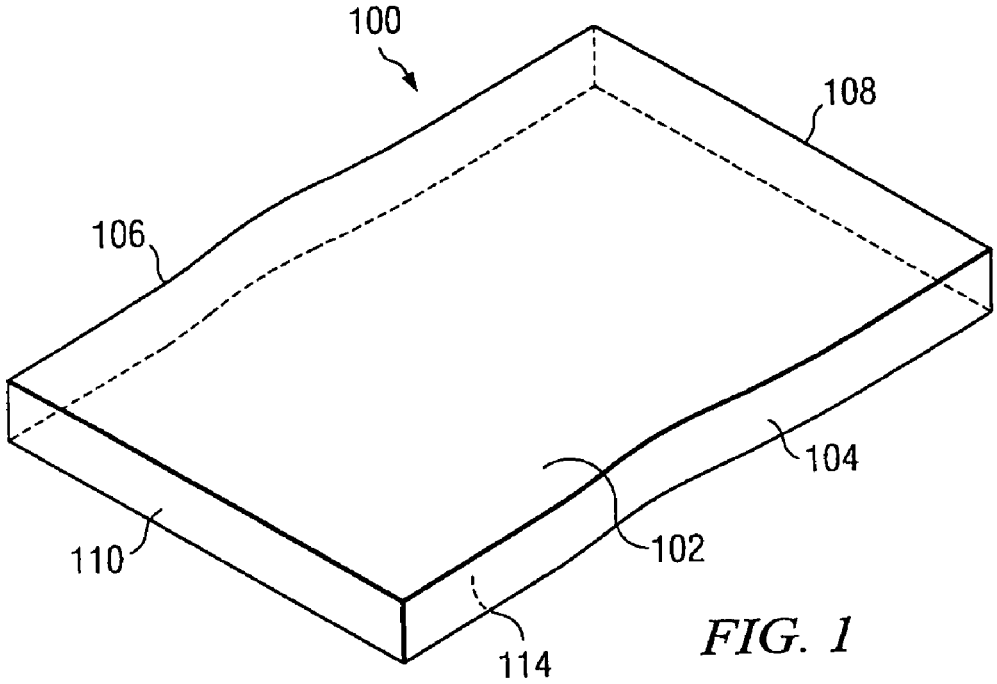
FIG. 1 illustrates a perspective view of a traveling baby diaper-changing pad.

FIG. 1 illustrates a perspective view of the traveling baby diaper-changing pad 100 which is flexible and includes a front surface 102, a first side surface 104, a second side surface 106, a top surface 108, a bottom surface 110 and a back surface 114 and is sized to the approximate size of a baby or infant.

Figure 2:
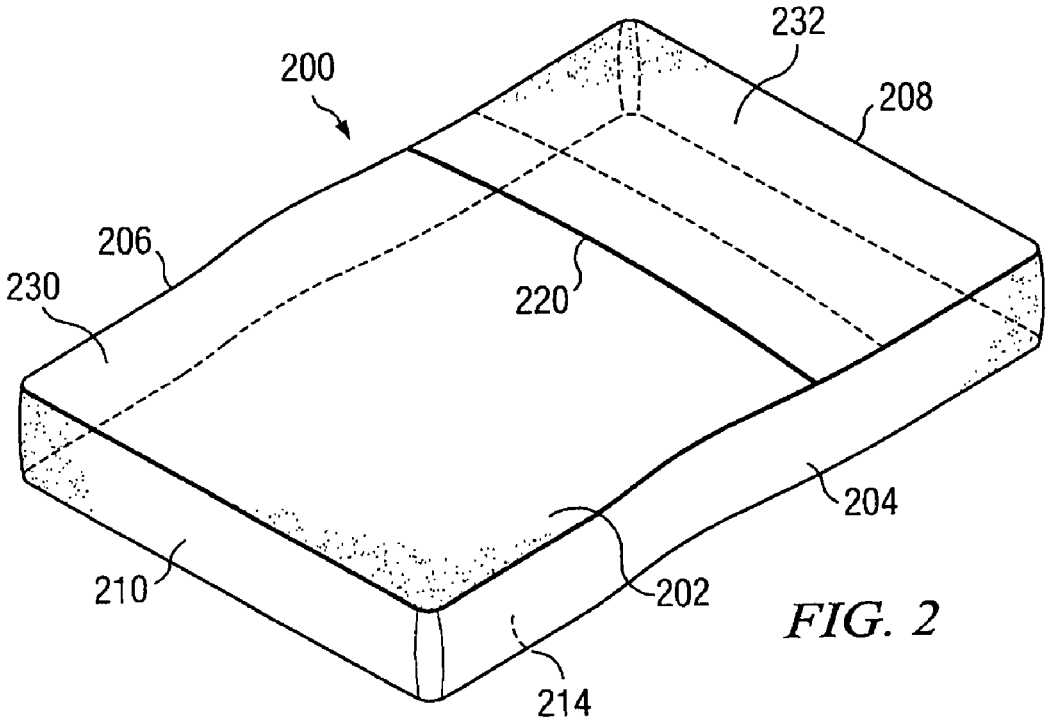
FIG. 2 illustrates a perspective view of a baby diaper-changing pad cover of the present invention.

FIG. 2 illustrates a perspective view of the baby diaper-changing pad cover 200 of the present invention. The baby diaper-changing pad cover 200 is formed from flexible material such as cotton, wool, polyester or other suitable material in order to cover the traveling baby diaper-changing pad 100. The baby diaper-changing pad cover 200 includes a top member 202 to cover the top surface 102 of the traveling baby diaper-changing pad, a first side member 204 to cover the first side surface 104, a second side member 206 to cover the second side surface 106, a top member 208 to cover the top surface 108, a bottom member 210 to cover the bottom surface 110 and a back member 212 to cover the back surface 112 of the baby diaper-changing pad. FIG. 2 additionally illustrates that the body diaper-changing pad cover 200 includes a slit member 220 which is shown extending in the traversed direction of the baby diaper-changing pad cover 200. The slit member 220 allows access to the interior of the baby diaper-changing pad cover 200 of the baby diaper-changing pad 100. It is through the slit member 200 that the traveling baby diaper-changing pad 100 can be inserted or removed from the baby diaper-changing pad cover 200 of the present invention. The front member 202 includes a first portion 230 and a second portion 232, and the first portion 230 may overlap the second portion 232 defining a overlap portion 234 which extends under the second portion 232.

Figure 3:
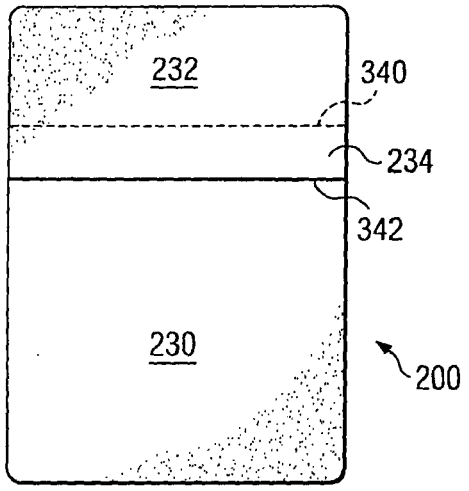
FIG. 3 illustrates a top view of the baby diaper-changing pad cover of the present invention.

FIG. 3 illustrates a top view of the baby diaper-changing pad cover 200 of the present invention. FIG. 3 illustrates the first portion 230, the second portion 232 and the overlapping portion 234 which is between a top edge 340 of the first portion 230 and a bottom edge 342 of the second portion 232.

Figure 4:
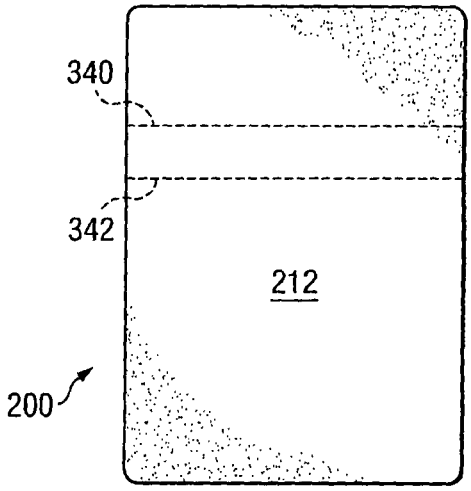
FIG. 4 illustrates a bottom view of the baby diaper-changing pad cover of the present invention.

FIG. 4 illustrates the back member 212 of the baby diaper-changing pad cover 200 and shows the top edge 340 and the bottom edge 342.

Figure 5:
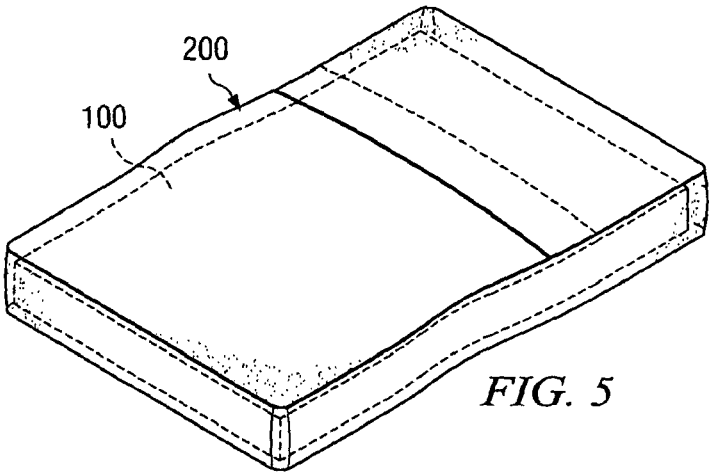
FIG. 5 illustrates a perspective view of the baby diaper-changing pad cover covering the traveling baby diaper-changing pad.

FIG. 5 illustrates that the traveling baby diaper-changing pad 100 is positioned within the baby diaper-changing pad cover 200 while FIG. 2 illustrates the baby diaper-changing pad cover 200 without the traveling baby-changing pad 100.

Figure 6:
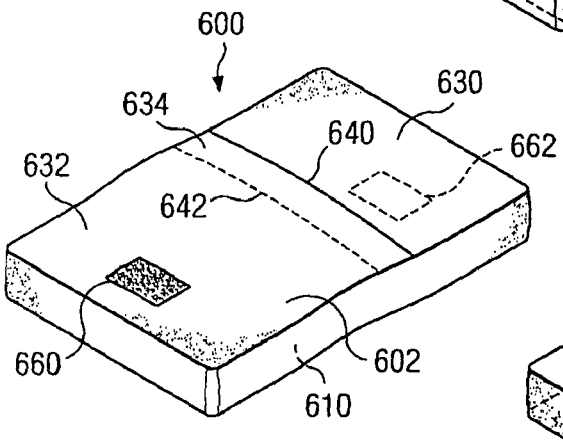
FIG. 6 illustrates a perspective view of the another embodiment of the baby diaper-changing pad cover.

FIG. 6 illustrates another embodiment of the baby diaper-changing pad cover 600. The baby diaper-changing pad cover 600 includes a front member 602 which is substantially coextensive with a back member 610 with the front member 602 being directly connected to the back member 610 in order to avoid the need for side cover members. The front member 602 includes a first portion 630 and a second portion 632 and FIG. 6 additionally shows the top edge 640 of the second portion 632 and a bottom edge 642 of the first portion 630. The top edge 640 defines a slit member 620 to allow the traveling baby-changing pad to be inserted and removed. FIG. 6 additionally illustrates an attachment apparatus 660, 662 for example Velcro which are loops and hooks so that the baby diaper-changing pad cover 600 may be folded over and held in place by the attachment apparatus 600, 662 for easy storage.

The front member 602 includes a first portion 630 and a second portion 632, and the first portion 630 may overlap the second portion 632 defining an overlap portion 634 which extends under the second portion 632.

Figure 7:
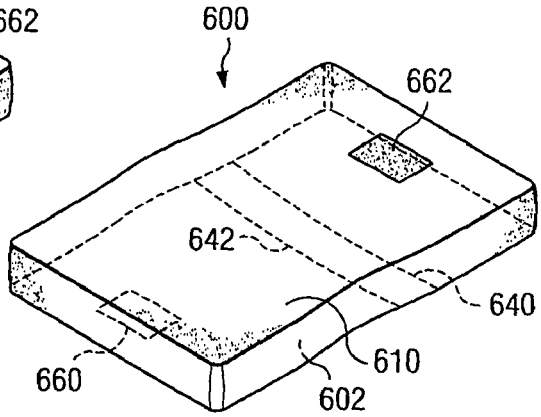
FIG. 7 illustrates a perspective view of the embodiment of the baby diaper-changing pad cover.

FIG. 7 illustrates a perspective view of the back member 610 and shows the top edge 640 and the bottom edge 642.

In all the above embodiments, the material of the baby diaper-changing pad cover may be quilted material in order to absorb wetness from the baby.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed.

The invention claimed is:

1. A traveling baby diaper-changing kit comprising:

a substantially flat rectangular flexible pad which can be readily folded in order to transport the substantially flat rectangular flexible pad in a convenient pouch or bag;

and a fitted cover comprising: a front member, a first side member connected to the front member, a second side member connected to the front member, a top member connected to the front member, a bottom member connected to the front member, and a back member substantially coextensive with the front member and connected to the first side member, the second side member, the top member and the bottom member, and hook and loop fasteners attached to and disposed within the respective perimeters of the front member and the back member so that the fitted cover may be folded over and held in place for easy storage;

wherein the front member comprises: a first portion, a second portion overlapping the first portion, and a transverse slit located at an end of the first portion so that the substantially flat rectangular flexible pad can be inserted or removed through the fitted cover.

* * * * *